US005231268A

United States Patent [19]

Hall et al.

[11] Patent Number: 5,231,268

[45] Date of Patent: Jul. 27, 1993

[54] PRINTED MICROWAVE SUSCEPTOR

[75] Inventors: Roger D. Hall, Frederick; Christopher J. Parks, Ellicott City, both of Md.

[73] Assignee: Westvaco Corporation, New York, N.Y.

[21] Appl. No.: 845,564

[22] Filed: Mar. 4, 1992

[51] Int. Cl.[5] ..... H05B 6/80

[52] U.S. Cl. ..... 219/10.55 E; 219/10.55 F; 219/10.55 M; 99/DIG. 14; 426/107; 426/111; 426/234; 426/243

[58] Field of Search ..... 219/10.55 E, 10.55 M, 219/10.55 F; 426/107, 113, 234, 243, 111; 99/DIG. 14

[56] References Cited

U.S. PATENT DOCUMENTS

| | | | |
|---|---|---|---|
| 4,190,757 | 2/1980 | Turpin et al. | 219/10.55 E |
| 4,518,651 | 5/1985 | Wolfe, Jr. | 219/10.55 E |
| 4,713,510 | 12/1987 | Quick et al. | 219/10.55 E |
| 4,825,025 | 4/1989 | Seiferth | 219/10.55 E |
| 4,876,427 | 10/1989 | Mode | 219/10.55 E |
| 4,878,765 | 11/1989 | Watkins et al. | 219/10.55 E |
| 4,914,266 | 4/1990 | Parks et al. | 219/10.55 E |
| 4,917,748 | 4/1990 | Harrison | 219/10.55 E |
| 4,982,064 | 1/1991 | Hartman et al. | 219/10.55 E |
| 5,002,826 | 3/1991 | Pollart et al. | 426/107 |
| 5,019,681 | 5/1991 | Lorence et al. | 219/10.55 E |

*Primary Examiner*—Bruce A. Reynolds
*Assistant Examiner*—Tu Hoang

[57] ABSTRACT

Paperboard packaging material for use in the manufacture of containers or inserts for containers for browning and crisping food in a microwave oven is prepared on a printing press. The components of the packaging material include paperboard or an equivalent microwave transparent substrate, a susceptor layer prepared from a printable aqueous susceptor-ink composition, and an intermediate coating applied to the paperboard substrate between the susceptor layer and the paperboard to provide a thermal barrier for the paperboard substrate. The thermal barrier layer may be coated or printed on the paperboard substrate as a substantially uniformly thick layer while the susceptor-ink layer may be pattern-printed on the substrate in varying thickness corresponding to the location of food intended to be packaged in containers prepared from the packaging material. The printed susceptor material is overprinted with a food contact coating. The invention also contemplates the use of pigments or the like in one or more of the food contact layer, susceptor layer or thermal barrier layer to facilitate the release of water vapor from these layers during the microwave heating process.

22 Claims, 1 Drawing Sheet

PRINTED MICROWAVE SUSCEPTOR

BACKGROUND OF INVENTION

The present invention relates to susceptor packaging materials and packages constructed therefrom for use in heating foods in a microwave oven. The invention is an improvement in U.S. Pat. No. 4,914,266 to Parks, and is related to the invention disclosed in U.S. patent application Ser. No. 574.736 filed Aug. 30, 1990, now U.S. Pat. No. 5,132,144. Parks, who is a coinventor of the present invention. The construction of the present invention represents a further refinement in the prior inventions of Parks and produces a level of performance not achieved by the prior inventions.

Current commercial microwave susceptor technology utilizes vapor deposited metallized films of aluminum on film that are laminated to paper or paperboard substrates. The metallized film technology is not readily adaptable to the application of susceptors in selected patterns nor can it be readily manipulated to control the level of heat generated in any one part of the susceptor substrate. The prior U.S. patent and pending patent application of Parks each address these problems and establish the viability of printed susceptors using known printing methods and equipment including gravure and flexography. The performance of containers prepared from the susceptor packaging materials of the Parks patent and patent application has been found to be comparable to metallized aluminum susceptors in the generation of heat and provides the flexibility of controlling both the location and amount of heat produced by the susceptor. However, during the development of those inventions, it was discovered that the substrate on which the susceptor was printed could become degraded during cooking from the generation of excess heat by the susceptor. The generation of excess heat increased the danger of fire or excessive smoking that needed to be minimized to provide a commercially acceptable product. Accordingly, the present invention was developed to address these problems and to provide a commercially acceptable susceptor packaging material of greater refinement, predictability and performance.

SUMMARY OF INVENTION

The present invention is directed to susceptor packaging material for a microwave oven that is prepared on a printing press. Carbon black and graphite are conductive carbon materials that are available in particle sizes which may be readily dispersed in printable ink vehicles. Inks incorporating conductive carbon materials can be printed on paperboard substrates to make susceptor packaging material useful in a microwave oven. However, during experimental cooking tests, it was discovered that the paperboard substrate in such packaging material could become degraded when exposed to microwave radiation as a result of the generation of excess heat by the susceptor. It is, therefore, an object of this invention to provide a thermal barrier between the paperboard substrate and the printed susceptor to protect the paperboard from excess heat.

Polyester coated paperboard has in the past been the substrate of choice for ovenable packaging. It is preferred because of its FDA status and because it is readily heat sealable for forming food packages. A polyester coating on paperboard was found to provide thermal barrier protection for susceptor food packaging.

However polyester coatings are not compatible with all types of susceptor coatings and, in particular, are not readily compatible with the preferred printable susceptor-ink composition of the present invention. Accordingly, in order to avoid these difficulties, a non-polyester thermal barrier layer is preferred which will have good adhesion to the paperboard substrate and also good adhesion with the printed susceptor-ink layer of the susceptor packaging material.

Sodium silicate is the preferred thermal barrier material of the present invention because it is compatible with the preferred susceptor-ink composition disclosed herein and because it is thermally stable at temperatures far in excess of those needed for microwave susceptors. Sodium silicate is also FDA approved for food contact use, it can readily be applied to paperboard via coating, printing, or the like, and it is low in cost. Other thermal barrier materials useful in the present invention include polyesters, silicones, urethanes, polyimides, polyamides, polysulfones, other inorganic silicates and combinations of those materials. When other thermal barrier coatings are used in the present invention, their surfaces may need to be treated for good adhesion with the preferred printable susceptor-ink composition (disclosed more fully hereinafter).

Sodium silicates are compounds of silica ($SiO_2$) and soda ash ($Na_2O$) and are generally available as aqueous solutions. They may be readily applied to paperboard by any well known coating process and may also be formulated so as to be printed on paperboard with known printing methods. Such solutions are believed to be useful as thermal barrier layers because solutions containing silicates contain residual moisture when dried. It is known that sodium silicate will retain from 10–30% moisture depending upon how it is dried. This permits a thermal barrier coating containing sodium silicate to be applied by a conventional coating method or on a printing press since all of the water in the solution need not be driven off during the drying step. Unfortunately this bound water sometimes presents problems during microwave heating when the water vaporizes under the influence of excess heat. To counter this problem, the thermal barrier coating of the present invention may include an inorganic pigment such as clay, calcium carbonate or the like to create a degree of porosity sufficient to allow the escape of water vapor. Accordingly the present invention incorporates the printed susceptor technology originally disclosed in U.S. Pat. No. 4,914,266, the improved susceptor-ink composition disclosed in pending application Ser. No. 574,736, now U.S. Pat. No. 5,132,144, and adds to that a thermal barrier layer between the substrate and susceptor layer more fully disclosed herein.

DETAILED DESCRIPTION

Figure 1:
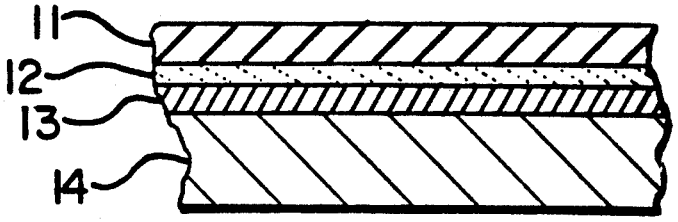
FIG. 1 of the drawing illustrates in cross section a typical laminate for the susceptor packaging material according to the present invention.

The present invention is directed to the manufacture and use of susceptor packaging material that may be prepared on a printing press. The use of graphite or conductive carbon black in a printable susceptor material in the manufacture of susceptor packaging material for microwave ovens is known. The conductive carbon material is preferably dispersed in an ink vehicle to produce a printable susceptor-ink composition which is printed on a microwave transparent substrate using conventional printing technology. However, prior to printing the susceptor-ink composition on the substrate, the substrate is preferably coated with a thermal barrier layer to insulate the substrate from excess heat generated by the susceptor-ink layer when exposed to microwave energy. Finally the printed susceptor material is overprinted with a suitable barrier coating formulation to provide a food contact surface.

FIG. 1 illustrates in cross section the preferred structure of the composite susceptor packaging material according to the present invention. Reference character 14 represents the substrate onto which the susceptor-ink composition is printed during the manufacture of the suscepto packaging material of the present invention. Layer 14 is formed from a microwave transparent material such as a dielectric sheet material, e.g., paperboard which provides the structural rigidity necessary for making packages or package inserts from the susceptor material. The upper surface of the paperboard substrate 14 may be coated or uncoated with the understanding that the type of coating used could influence the thermal characteristics of the paperboard, the type of thermal barrier coating used and the adhesion between the paperboard, thermal barrier coating and susceptor-ink coating. The lower surface is preferably coated with a clay containing coating to provide a surface useful for printing graphics and other information about the use of the susceptor material or the products packaged in packages made from the susceptor material. However, in some packaging applications, the lower surface or backside of the paperboard substrate 14 may be left uncoated if low quality or no graphics are needed, and to facilitate the escape of water vapor from the substrate under severe heating conditions. The backside of the paperboard substrate 14 could also be applied with a food contact coating (not shown) of the same class mentioned hereinbefore when the packaging material is used as an insert. This would allow the user to place the food product on either side of the susceptor for cooking.

Referring also to FIG. 1, reference character 11 represents the food contact layer. This layer serves several purposes. Since the underlying layers may be moisture sensitive, layer 11 serves to protect the underlying layers from moisture penetration during storage and cooking. It also serves to protect the food products packaged with the susceptor material from possible contaminants which might migrate from the underlying layers. Release properties may be incorporated into the food contact coating 11 to prevent sticking of food products and in order that the food products may be easily removed from the susceptor packages after cooking. Alternatively, a separate release coating-(not shown) could be applied over layer 11 if desired. Also, pigments may be added to the food contact coating if desired to produce a specific colored surface and other pigments may be incorporated to make the layer porous for release of water vapor if needed. Suitable materials for use in the food contact layer 11 should be thermally stable in excess of 300 degrees F., and should meet all FDA guidelines for contact with aqueous and fatty foods under all conditions experienced during packaging, storage and cooking. Examples of coatings for layer 11 include polyesters (Morton ADCOTE 33R2AH), acrylics (Goodrich HYCAR 26315), and silicones (Dow Corning SYL-OFF 7600). An example of an additional release coating that could be applied over the food contact layer 11 is QUILON C from DuPont. The food contact layer is applied either as a coating or on a printing press in an amount of from about 3–25 lbs./ream (ream size 3,000 square feet).

Layer 12 in FIG. 1 designates the susceptor-ink layer which is printed on the substrate 14. This layer provides the means whereby heat is generated when exposed to microwave radiation for achieving microwave browning. Layer 12 comprises at least two components, an ink vehicle and an electrically conductive microwave interactive material. The preferred ink vehicle for the present invention is sodium silicate as disclosed in pending application Ser. No. 574,736, now U.S. Pat. No. 5,132,144, and the preferred microwave interactive material is a conductive carbon component, for example, graphite. Sodium silicate serves as a fire retardant binder for the microwave interactive graphite. As taught in the aforementioned pending application, sodium silicate has the thermal stability necessary for the intended application, unlike conventional printing ink binders such as polyesters, acrylics and nitrocelluloses. While polyesters and acrylics have been found to be suitable for the food contact layer 11, they have not demonstrated the thermal stability required for a binder in susceptor coating. Sodium silicate is available in weight ratios of silica to soda ash of from about 4:1 to about 1.5:1. The preferred ratio is on the order of about 3:1. A suitable sodium silicate is available from Occidental Chemical Company sold under the brand name 40 Clear for the purpose intended. Particulate graphite is available in a wide range of particle sizes, shapes, and purities. For gravure printing, a particle size less than about 100 microns may be employed but less than about 10 microns is preferred. Examples of graphites that have been successfully employed for susceptor coatings in the present invention include Superior Graphite 5539, having spherical particles of about 5 microns and a purity of 99.8% carbon, and Asbury Graphite Micro 250 with a particle size of about 0.5 micron. The ratio of graphite to sodium silicate solids in the susceptor-ink composition can range from about 15 to about 75% graphite by weight. As an example, a ratio of one part Superior Graphite 5539 and 3 parts sodium silicate 40 Clear, adjusted to a total solids of about 40%, and applied to a suitable substrate at about 20 lbs/3000 sq. ft. has been found useful for browning microwave pizza. The preferred susceptor-ink layer has a surface resistivity of from about 167 to 10,000 ohm/sq., and comprises from about 15–75 weight percent finely divided carbon and from 82–25 weight percent sodium silicate binder, applied at 40–55% solids.

Layer 13 is the thermal insulator component of the present invention applied to the substrate 14 between the substrate and the microwave susceptor layer 12. Layer 13 is designed to provide a thermal barrier between the paperboard substrate 14 and the microwave susceptor layer 12 to prevent any degradation of the paperboard as a result of the generation of excess heat by the susceptor when exposed to microwave radiation. Thermal barrier materials useful in the present invention include polyesters, silicones, urethanes, polyimides, polyamides, polysulfones, sodium silicate and other inorganic silicates and combinations thereof. The preferred thermal barrier is a coating containing sodium silicate which would be compatible with the preferred susceptor-ink layer.

If polyester is used as the thermal barrier 13, an extrusion coating of about 1.25 mil in thickness has been found to be useful. However, when polyester is used, proper adhesion of the preferred sodium silicate containing susceptor-ink composition may not be easily achieved. Priming of the polyester surface with silanes or the addition of silanes to the susceptor-ink composition has improved this adhesion somewhat. Flame or corona treatment of the polyester surface has also improved this adhesion to the point where the susceptor-ink printing composition ma be successfully applied with a gravure application.

With the use of sodium silicate as the thermal insulation layer, adhesion of the preferred susceptor-ink layer is not a problem. First, sodium silicate will readily adhere to the surface of a paperboard substrate, particularly an uncoated substrate, and subsequent adhesion between the sodium silicate thermal layer and the sodium silicate containing susceptor-ink layer is no problem. Moreover a clay coated paperboard substrate will present even fewer problems than uncoated paperboard because of the tendency of any aqueous solution to soak into uncoated paperboard. It is also possible to use the polyester coated paperboard normally used for ovenable packaging in the present invention, with an appropriate treatment as outlined above, if the polyester coating is not of sufficient thickness to serve as a true thermal protection layer. While it may be possible to use the same grade sodium silicate in the preferred thermal insulating layer 13 and as the binder in the preferred susceptor-ink composition layer 12, it may be preferable to use sodium silicates with different ratios of silica to soda as in each layer. If it is desired to combine both polyester and sodium silicate as the thermal layer, flame treatment of the first down polyester coating will permit good adhesion to a second down sodium silicate thermal coating followed by the printed susceptor-ink layer containing sodium silicate. When sodium silicate alone is used as the thermal barrier layer a solution having a solids content of from about 30–50% is preferred applied to the dielectric substrate in an amount of from about 6 to 24 lbs./ream (ream size 3000, square feet).

Another feature of the present invention involves the selective pigmentation of one or more of the food contact layer 11, susceptor-ink composition layer 12 or the thermal barrier layer 13. Sodium silicate is known to retain a large amount of bound water, particularly when dried at the temperatures experienced on a gravure press which are lower than those that would be experienced during microwave cooking. Likewise the sodium silicate in the thermal barrier layer would retain moisture. Obviously some of this bound water is likely to be released when the susceptor layer 12 is heated to temperatures in excess of 300 degrees F. upon exposure to microwave radiation. As this moisture is liberated, it can produce pinholes and voids in the layers which reduces the rub resistance of the coatings after cooking. To counter this effect, both the food contact coating applied as layer 11 and the thermal barrier coating applied as layer 13 may be pigmented with clay, calcium carbonate or other non-microwave interactive pigments to create a somewhat porous structure which allows the escape of water vapor from the coatings without reducing their rub resistance. Since the interactive layer 12 is already pigmented with graphite, the escape of moisture from this layer does not present a problem in most cases, besides, the addition of non-microwave interactive materials to the microwave interactive layer would reduce its efficiency. However, in extreme cases, some additional pigmentation could be added to the microwave interactive layer 12.

What is claimed is:

1. A composite susceptor material which generates heat by absorption of microwave energy comprising:

(a) a porous, dielectric, substrate substantially transparent to microwave radiation;

(b) a thermal barrier layer applied to the surface of said substrate;

(c) an electrically conductive layer printed on an exposed surface of said thermal barrier layer, said electrically conductive layer comprising a susceptor-ink composition of a microwave interactive material dispersed in a binder and capable of being applied by a printing press; and, (d) a product contact layer applied over the electrically conductive layer having characteristics suitable for packaging food products.

2. The composite susceptor material of claim 1 wherein the electrically conductive layer comprises from about 15–75 weight percent finely divided conductive carbon and from 85–25 weight percent sodium silicate binder applied at 40–50% solids.

3. The composite susceptor material of claim 2 wherein the electrically conductive layer is applied over the thermal barrier layer in sufficient thickness to achieve a surface resistivity of from about 167 to 10,000 ohm/sq.

4. The composite susceptor material of claim 3 wherein the thermal barrier layer comprises an insulating material selected from the group consisting of polyester, silicones, urethanes, polyimides, polyamides, polysulfones and inorganic silicates.

5. The composite susceptor material of claim 4 wherein the thermal barrier layer comprises a sodium silicate coating having a solids content of from about 30 to 50% and is applied to the dielectric substrate in an amount of from about 6 to 24 lbs/ream.

6. The composite susceptor material of claim 5 wherein the product contact layer comprises a material selected from the group consisting of polyesters, acrylics and silicones and is applied over the electrically conductive layer in an amount of from about 3 to 25 lbs./ream.

7. The composite susceptor material of claim 6 wherein the thermal barrier layer further comprises up to about 50 weight percent inorganic pigment selected from the group consisting of clay, calcium carbonate and titanium dioxide.

8. The composite susceptor material of claim 7 wherein the porous, dielectric substrate is selected from the group consisting of uncoated paperboard, paperboard having a pigmented coating and paperboard containing a surface coating of a polyester material.

9. The composite susceptor material of claim 8 wherein the food contact layer further comprises a release agent.

10. The composite susceptor material of claim 8 wherein the food contact layer is overcoated with a coating containing a release agent.

11. A process of manufacturing a composite susceptor material which generates heat by absorption of microwave energy comprising:

(a) providing a porous, dielectric, substrate substantially transparent to microwave radiation;

(b) applying to one surface of said substrate a thermal barrier layer for insulating the substrate from excess heat generated by microwave energy;

(c) printing on an exposed surface of said thermal barrier layer a susceptor layer of a susceptor-ink composition comprising a dispersion of finely divided, electrically conductive microwave interactive particles suspended in a printable ink vehicle; and, (d) applying over said susceptor layer and in contact therewith a protective layer having characteristics suitable for contact with fatty foods or the like.

12. The process of claim 11 wherein the susceptor layer is printed on the thermal barrier layer with a printing press in a pattern and with varying thickness to generate varying degrees of heat throughout the susceptor material when exposed to microwave energy.

13. The process of claim 12 wherein the susceptor layer is printed on said thermal barrier layer with a printing process selected from the group consisting of gravure, offset, flexography and silkscreen.

14. A disposable, microwavable food heating container adapted to accommodate food products, comprising an outer container body formed from a composite susceptor material comprising a microwave transparent dielectric substrate, said substrate having printed on one surface thereof a susceptor-ink composition comprising microwave interactive particles suspended in a printable ink vehicle in a preselected pattern corresponding to a location of food packaged in the container, a food contact coating applied over the printed susceptor-ink composition to provide a food contact surface for food packaged in the container, and a thermal barrier layer between and in contact with the microwave transparent dielectric substrate and the printed susceptor-ink composition to insulate the substrate from excess heat generated by the susceptor-ink composition when the container and its food products are heated in a microwave oven.

15. The food heating container of claim 14 wherein the thermal barrier layer comprises an insulating material selected from the group consisting of polyesters, silicones, urethanes, polyimides, polyamides, polysulfones and inorganic silicates.

16. The food heating container of claim 15 wherein the thermal barrier layer is prepared from a sodium silicate solution having a solids content of from about 30 to 50% which is applied to the dielectric sheet material in an amount of from about 6 to 24 lbs./ream.

17. The food heating container of claim 16 wherein an inorganic pigment is incorporated into the thermal barrier layer in an amount of up to about 50 weight percent to provide voids in the coating for releasing bound moisture associated with the sodium silicate during the microwave heating process.

18. The food heating container of claim 17 wherein the susceptor-ink composition comprises from about 15–75 weight percent finely divided conductive carbon particles suspended in a binder of from about 85–25 weight percent sodium silicate applied at 40–55% solids.

19. The food heating container of claim 18 wherein the thickness of the susceptor-ink composition is varied within the pattern printed on the thermal barrier layer to provide varying degrees of heat for the food products packaged in said container when exposed to microwave energy.

20. The food heating container of claim 19 wherein the food contact coating comprises a material selected from the group consisting of polyesters, acrylics and silicones in an amount of from about 3 to 25 lbs./ream.

21. The food heating container of claim 20 wherein a release material is included in the food contact coating or applied over the food contact coating to keep the food products packaged in the container from sticking to the container.

22. The food heating container of claim 21 wherein the microwave transparent, dielectric substrate is paperboard.

* * * * *